US010337800B2

(12) United States Patent
Taylor

(10) Patent No.: US 10,337,800 B2
(45) Date of Patent: Jul. 2, 2019

(54) MODULAR PLATE AND SHELL HEAT EXCHANGER

(71) Applicant: Westinghouse Electric Company LLC, Cranberry Township, PA (US)

(72) Inventor: Creed Taylor, Signal Mountain, TN (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 9 days.

(21) Appl. No.: 15/629,791

(22) Filed: Jun. 22, 2017

(65) Prior Publication Data

US 2017/0284744 A1 Oct. 5, 2017

Related U.S. Application Data

(63) Continuation of application No. 13/348,832, filed on Jan. 12, 2012, which is a continuation-in-part of
(Continued)

(51) Int. Cl.
*F28D 1/06* (2006.01)
*F28D 7/10* (2006.01)
(Continued)

(52) U.S. Cl.
CPC ..... *F28D 9/0006* (2013.01); *F22D 1/006* (2013.01); *F28D 9/0031* (2013.01);
(Continued)

(58) Field of Classification Search
CPC .... F28D 9/0006; F28D 9/0031; F28D 9/0012; F28D 9/0043; F28F 9/00; F28F 3/08; F28F 3/086; F28F 3/10
(Continued)

(56) References Cited

U.S. PATENT DOCUMENTS 2,496,301 A * 2/1950 Meixl ..... F28F 9/22 165/134.1
2,938,712 A 5/1960 Pellmyr
(Continued)

FOREIGN PATENT DOCUMENTS

CN 1202236 A 12/1998
CN 1238833 A 12/1999
(Continued)

OTHER PUBLICATIONS 13735908.9-1602/2802835 PCT/US2013020206—Extended European search report includes supplementary European search report and European search opinion (Forms 1507S, 1503, P0459, P04A42, 1703).

*Primary Examiner* — Jason N Thompson
(74) *Attorney, Agent, or Firm* — Richard J. Coldren; Westinghouse Electric Company LLC

(57) ABSTRACT

A modular plate and shell heat exchanger in which welded pairs of heat transfer plates are tandemly spaced and coupled in parallel between an inlet and outlet conduit to form a heat transfer assembly. The heat transfer assembly is placed in the shell in order to transfer heat from a secondary to a primary fluid. Modules of one or more of the heat transfer plates are removably connected using gaskets at the inlet and outlet conduits which are connected to a primary fluid inlet and a primary fluid outlet nozzle. The heat transfer assembly is supported by a structure which rests on an internal track which is attached to the shell and facilitates removal of the heat transfer plates. The modular plate and shell heat exchanger has a removable head integral to the shell for removal of the heat transfer assembly for inspection, maintenance and replacement.

18 Claims, 8 Drawing Sheets

Related U.S. Application Data application No. 12/432,147, filed on Apr. 29, 2009, now Pat. No. 9,285,172.

(51) Int. Cl.

| | |
|---|---|
| ***F28F 9/26*** | (2006.01) |
| ***F28D 9/00*** | (2006.01) |
| ***F28F 3/08*** | (2006.01) |
| ***F22D 1/00*** | (2006.01) |
| *F28D 21/00* | (2006.01) |

(52) U.S. Cl.

CPC ..... *F28D 9/0043* (2013.01); *F28F 3/083* (2013.01); *F28D 2021/0054* (2013.01); *F28F 2280/02* (2013.01); *Y10T 29/49352* (2015.01)

(58) Field of Classification Search

USPC ..... 165/72, 73, 74, 75, 76, 143, 145

See application file for complete search history.

(56) References Cited

U.S. PATENT DOCUMENTS

| | | | | |
|---|---|---|---|---|
| 3,796,547 | A | 3/1974 | Muenger | |
| 4,136,734 | A | 1/1979 | Sasaki et al. | |
| 4,260,013 | A * | 4/1981 | Sumitomo | F28F 3/083 165/145 |
| 4,291,752 | A | 9/1981 | Bridgnell | |
| 4,323,398 | A | 4/1982 | Simon | |
| 4,432,307 | A | 2/1984 | Godin | |
| 4,461,346 | A | 7/1984 | Hoshino et al. | |
| 4,548,260 | A | 10/1985 | Stachura | |
| 4,741,392 | A | 5/1988 | Morse | |
| 4,869,067 | A | 9/1989 | Sears | |
| 4,924,938 | A | 5/1990 | Plaschkes | |
| 4,969,510 | A * | 11/1990 | Greune | F28D 7/06 165/176 |
| 5,088,552 | A | 2/1992 | Raunio | |
| 5,131,459 | A | 7/1992 | Thompson et al. | |
| 5,203,406 | A * | 4/1993 | Blomgren | C01D 3/06 159/28.6 |
| 5,383,517 | A | 1/1995 | Dierbeck | |
| 5,400,853 | A | 3/1995 | Wolters | |
| 5,452,758 | A | 9/1995 | Mauterer | |
| 5,590,707 | A | 1/1997 | Mauterer | |
| 6,098,701 | A | 8/2000 | Blomgren | |
| 6,918,433 | B2 | 7/2005 | Kontu | |
| 7,066,241 | B2 | 6/2006 | Garimella | |
| 7,204,300 | B2 | 4/2007 | Kontu | |
| 7,726,388 | B2 | 6/2010 | Toda | |
| 8,673,473 | B2 | 3/2014 | Odumodu | |
| 2003/0116305 | A1 | 6/2003 | Beddome et al. | |
| 2003/0131977 | A1 | 7/2003 | West | |
| 2004/0109798 | A1* | 6/2004 | Chopard | B01D 63/082 422/198 |
| 2004/0188078 | A1 | 9/2004 | Wu et al. | |
| 2007/0029077 | A1* | 2/2007 | Mirolli | F28D 9/0006 165/167 |
| 2007/0251671 | A1 | 11/2007 | Barnes et al. | |
| 2007/0256817 | A1* | 11/2007 | Toda | F28D 1/05366 165/143 |
| 2007/0295479 | A1 | 12/2007 | Fulmer | |
| 2008/0179049 | A1 | 7/2008 | Mathur et al. | |
| 2009/0056924 | A1 | 3/2009 | Inatomi et al. | |
| 2009/0133861 | A1 | 5/2009 | Kim | |
| 2010/0162967 | A1 | 7/2010 | Taylor | |
| 2011/0024082 | A1* | 2/2011 | Bharne | F28D 9/0012 165/95 |
| 2015/0082825 | A1* | 3/2015 | Santini | F24F 13/20 62/426 |

FOREIGN PATENT DOCUMENTS

| | | | |
|---|---|---|---|
| CN | 1913136 | A | 2/2007 |
| CN | 102187174 | A | 9/2011 |
| EP | 0174554 | A1 | 3/1986 |
| FR | 2510729 | A1 | 2/1983 |
| GB | 356687 | A | 9/1931 |
| GB | 2054819 | A | 2/1981 |
| JP | S61181965 | U | 11/1986 |
| JP | S53213629 | A | 9/1988 |
| JP | H01119650 | A | 5/1989 |
| JP | H02187593 | A | 7/1990 |
| JP | H0590167 | U | 12/1993 |
| JP | H07113594 | A | 5/1995 |
| JP | H11294973 | A | 10/1999 |
| JP | 2000120585 | A | 4/2000 |
| JP | 2001041681 | A | 2/2001 |
| JP | 2002327991 | A | 11/2002 |
| TW | 201042232 | A | 12/2010 |
| WO | 9109262 | A1 | 6/1991 |
| WO | 9930099 | A1 | 6/1999 |
| WO | 2006091173 | A1 | 8/2006 |
| WO | 2008046952 | A1 | 4/2008 |
| WO | 2009152831 | A1 | 12/2009 |
| WO | 2010132302 | A2 | 11/2010 |

* cited by examiner

MODULAR PLATE AND SHELL HEAT EXCHANGER

CROSS REFERENCE TO RELATED APPLICATION

This application is a continuation application of U.S. patent application Ser. No. 13/348,832, filed Jan. 12, 2012, which application is a continuation-in-part of U.S. patent application Ser. No. 12/432,147, filed Apr. 29, 2009.

BACKGROUND

1. Field

The present invention relates generally to heat exchangers and, more particularly to modularization for stacked plate heat exchangers.

2. Description of the Related Art

The feedwater for steam generators in nuclear power plants is typically preheated before being introduced into the secondary side of the steam generators. Similarly, feedwater is preheated before being introduced into boilers for non-nuclear power plant applications. Feedwater heat exchangers are typically used for this purpose. Conventionally, heat exchanger designs are divided into two general classes; heat exchangers with a plate structure and those with a tube and shell structure. The major difference in the two classes, with regard to both construction and heat transfer, is that the heat transfer surfaces are mainly plates in one structure and tubes in the other.

The tube and shell heat exchanger in a number of feedwater heater applications employs a horizontal or vertical tubular shell having hemispherical or flat ends. The inside of the horizontal shell is divided into sections by a tube sheet which is normal to the axis of the shell. More specifically, at one end of the shell, a water chamber section is defined on one side of the tube sheet that includes a water inlet chamber having a water inlet opening and a water outlet chamber having a water outlet opening. In a U-tube tube and shell heat exchanger plurality of heat transfer tubes are bent at their mid portions in a U shape and extend from the other side of the tube sheet along the axis of the shell. These tubes are fixed to the tube sheet at both ends such that one end of each of the tubes opens in the water inlet chamber, while the other end opens in the water outlet chamber. Another type of tube and shell heat exchanger employs straight tubes with an inlet chamber and an outlet chamber respectively at opposite ends of the tubes. The heat transfer tubes are supported by a plurality of tube supporting plates, spaced at a suitable pitch in the longitudinal direction of the tubes. An inlet opening for steam and a drain inlet and outlet are formed in the shell in the portion in which the tubes extend.

In operation, the feedwater coming into the feedwater heater from the water inlet chamber flows through the U-shaped heat transfer tubes and absorbs the heat from the heating steam coming into the feedwater heater from the steam inlet opening to condense the steam. The condensate is collected at the bottom of the shell and discharged to the outside through a drain in the bottom of the shell. Thanks to the cylindrical shape of the shell and the heat exchange tubes, the structure is well suited as a pressure vessel, and thus tube and shell heat exchangers have been used in extremely high pressure applications.

The most significant drawback of the tube and shell heat exchangers is their heavy weight when compared to the surface area of the heat transfer surfaces. Due to that, the tube and shell heat exchangers are usually large in size. Also, it is difficult to design and manufacture tube and shell heat exchangers when the heat transfer, flow characteristics and expense are taken into account.

A typical plate heat exchanger is composed of rectangular, ribbed or grooved plates, which are pressed against each other by means of end plates, which, in turn, are tightened to the ends of the plate stack by means of tension rods or tension screws. The clearances between the plates are closed and sealed with banded seals on their outer circumference and the seals are also used at the flow channels. Since the bearing capacity of the sleek plates is poor, they are strengthened with the grooves which are usually arranged crosswise in adjacent plates, wherein they also improve the pressure endurance of the structure when the ridges of the grooves are supported by each other. However, a more important aspect is the significance of the grooves for heat transfer; the shape of the grooves and their angle with respect to the flow, affect the heat transfer and pressure losses. In a conventional plate heat exchanger, a heat supplying medium flows in every other clearance between the plates and a heat receiving medium flows in the remaining clearances. In alternate plate pairs the flow is conducted in between the plates via holes located in the vicinity of the corners of the plates. Each clearance between the plates in alternate plate pairs always contains two holes with closed rims and two other holes functioning as inlet and outlet channels for the clearance between the plates. The plate heat exchangers are usually constructed of relatively thin plates when a small and light structure is desired. Because the plates can be profiled into any desired shape, it is possible to make the heat transfer properties suitable for almost any type of application. The greatest weakness in conventional plate heat exchangers is the seals which limit the pressure and temperature endurance of the heat exchangers. In several cases, the seals have impaired the possibility of use with heat supplying or heat receiving corrosive medium.

Attempts have been made to improve the plate heat exchanger construction by leaving out all of the seals and replacing them with soldered joints or welded seams. Plate heat exchangers fabricated by soldering or welding usually resemble those equipped with seals. The most significant external difference is the absence of tension screws between the ends. However, the soldered or welded structure makes it difficult if not impossible to nondestructively dissemble such heat exchangers for cleaning Attempts have been made to combine the advantages of the tube and shell heat exchanger and the plate heat exchanger in heat exchangers whose construction partly resembles both of these basic types. One such solution is disclosed in the U.S. Pat. No. 5,088,552, in which circular or polygonal plates are stacked on top of each other to form a stack of plates which is supported by means of end plates. The plate stack is encircled by a shell, the sides of which are provided with inlet and outlet channels for corresponding flows of heat supplying and heat receiving medium. Differing from the conventional plate heat exchanger, all fluid flows into the clearances between the plates are directed from outside the plates. When the heat exchanger according to the publication is closed by welding, it is possible to attain the same pressures as when using a tube and shell heat exchanger with the heat transfer properties of a plate heat exchanger.

International Publication WO 91/09262 purports to present an improvement on the foregoing publication, which more distinctly exhibits features typical of both plate heat exchangers and tube and shell heat exchangers. The circular plates are drawn together in pairs by welding them together by the rims of holes which form an inlet and outlet channel. By welding the plate pairs fabricated in the above manner together by the outer perimeters of the plates, a closed circuit is attained for the flow of one heat transfer medium. Differing from the conventional plate heat exchanger, this structure is welded and there are only two holes in the plates. The flow of another heat transfer medium is directed to every other clearance between the plates by means of a shell surrounding the stack of plates. In order to prevent the flow from running between the plate stack and the shell, seals are utilized which are primarily used as deflectors for the flow. Obviously, pressure endurance is not required of the deflectors. Due to the structure of the plate stack, it is difficult to implement the seals. Elastic rubber gaskets are suggested for the seals so that it is possible to disassemble the heat exchanger, e.g., for cleaning purposes.

The shell and tube heat exchanger currently used in nuclear power plants has a common design flaw that when tube degradation occurs, in an effort to minimize leakage, the only option is to plug the damaged tube resulting in a loss of thermal duty. The loss of thermal duty in the feedwater system is costly for nuclear power plants and eventually requires the replacement of the shell and tube feedwater heater. Another limitation of the shell and tube design is that the shell side inspection is typically limited to small hand holes and inspection ports and as a result corrosion/erosion damage is difficult to detect. Significant corrosion/erosion has been sustained by the internal baffling which can lead to (1) flow bypass and thermal performance degradation, and (2) tube wear due to flow induced vibration. Significant corrosion/erosion has also been observed on the inner shell surface of the shell and tube feedwater heater design.

Therefore, a new feedwater heater design is desired for long term, sustainable thermal duty and for improved long term component integrity relative to the current shell and tube feedwater heater design. Preferably, long term, sustainable thermal duty will be achieved by replacement or repair of the heat transfer surfaces, as needed, instead of requiring that the heat transfer surface be removed from service. Additionally, it is desirable to be able to increase the heat transfer capability of the feedwater heater to accommodate power plant uprates without replacing the entire feedwater heater.

SUMMARY

The foregoing objectives are achieved by a modular plate and shell feedwater heater in which welded heat transfer plate pairs are placed in a shell in order to transfer heat from the drain flow and extraction steam to the feedwater in a nuclear power plant. The heat transfer plate pairs, or welded or otherwise bonded groupings of heat transfer plate pairs, i.e., modules of heat transfer plate pairs, are arranged in tandem and at least some of the modules are connected using gaskets and share, in parallel, a common inlet conduit and an outlet conduit which are respectively connected to feedwater inlet and outlet nozzles. The inlet and outlet conduits and heat transfer plate pairs form a heat transfer assembly that is preferably supported by a structure which rests on and is moveable along an internal track attached to the interior of the shell, which facilitates removal of the heat transfer plates from the shell. The modular plate and shell feedwater heater has a removable head integral with the shell for removal of the heat transfer plates for inspection, repair or replacement. Preferably, the inlet and outlet nozzles are sealed to and extend through the removable head.

Preferably, the heat exchanger provided for herein includes a means for increasing the heat exchange capacity of the unit over time to accommodate upratings of the plant in which the heat exchanger is installed. In one embodiment, the inlet and outlet conduits include a number of additional attachment points for pairs of the heat transfer plates that are initially plugged. In another embodiment, the inlet and outlet conduits can be expanded by the attachment of additional heat transfer plate pairs or modules. In the latter embodiment, the heat exchanger may initially be provided with a spacer module having no or relatively negligible heat transfer capacity that is supported in tandem with the heat transfer plate modules. A heat transfer plate module may later be substituted for the spacer module to increase the heat transfer capacity of the heat exchanger. Desirably, at least some of the couplings between the pairs of heat transfer plates, or modules of bonded pairs of heat transfer plates, are detachable for ease of repair and replacement. Preferably, tie rods connect the modules; and in the embodiment where the inlet and outlet conduits extend between modules, the tie rods provide compressive force for pressure seals at the interface of the conduit segments of the interfacing modules to form a tight seal.

Preferably, the heat transfer assembly is withdrawn from the shell with the removable head. Alternately, a manway is provided in the shell for gaining access to the interior of the shell for disconnecting the feedwater inlet nozzle from the feedwater inlet conduit and for disconnecting the feedwater outlet conduit from the feedwater outlet nozzle or both options may be provided.

Desirably, the modules have support panels at each end between which the tie rods extend. The heat transfer plate pairs are sandwiched between the support panels and in one embodiment, the primary fluid inlet conduit and the primary fluid outlet conduit pass through the modules. Preferably, the support panels are thicker than the heat transfer plates. In one embodiment the heat transfer plates between the support panels are welded to each other and to the support panels and adjacent support panels are mechanically connected to each other.

The invention also provides for a method of cleaning or repairing the feedwater heater which includes the steps of: accessing the interior of the pressure vessel shell; removing at least one pair of heat transfer plates from the heat transfer assembly of heat transfer plates; cleaning, repairing, or replacing the removed pair of heat transfer plates; and reconnecting the cleaned, repaired or replaced pair of heat transfer plates to the heat transfer assembly. Preferably, the step of accessing the interior of the pressure vessel shell includes removing the detachable head; and the step of removing at least one pair of heat transfer plates comprises removing the one pair of heat transfer plates from the feedwater inlet conduit and the feedwater outlet conduit.

The invention further includes a method of repairing, inspecting, cleaning or uprating the feedwater heater wherein the pressure vessel has a detachable head. The method comprises the steps of: removing the detachable head or otherwise accessing the interior of the pressure vessel shell; and disconnecting the feedwater inlet conduit and the feedwater outlet conduit from the feedwater inlet nozzle and the feedwater outlet nozzle, respectively, while the heat transfer assembly is in the pressure vessel. This method further includes the step of replacing a defective pair of heat transfer plates as well as the step of increasing the number of pairs of heat transfer plates after the feedwater heater has been placed in service to uprate the feedwater heater.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Current feedwater heater designs employed in nuclear power plants utilize a shell and tube heat exchanger arrangement. Another general type of heat exchanger that has been in existence since 1923 is the plate and frame heat exchanger. The latter is characterized by a compact design, high heat transfer coefficients, high fluid pressure drop within the plates and is generally limited to low pressure fluids. The embodiments described herein provide a plate and shell feedwater heater that combines and optimizes the aspects of a plate and frame heat exchanger and the traditional shell and tube type heat exchanger that is conveniently serviceable and can be easily altered, relatively inexpensively, to increase its heat transfer capacity, where desired.

Figure 1:
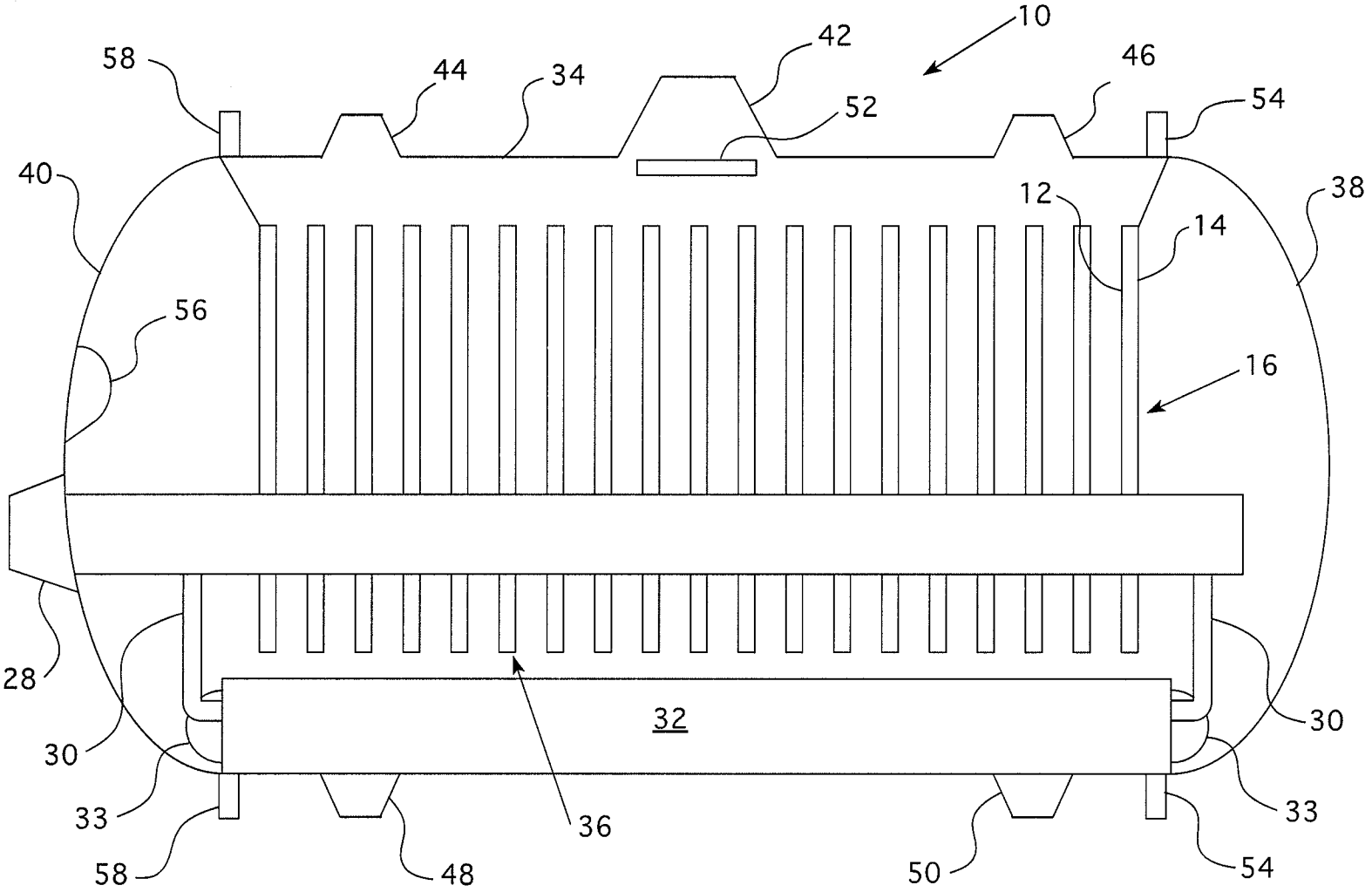
FIG. 1 is an elevational view of the feedwater heater of one embodiment of this invention.
Figure 2:
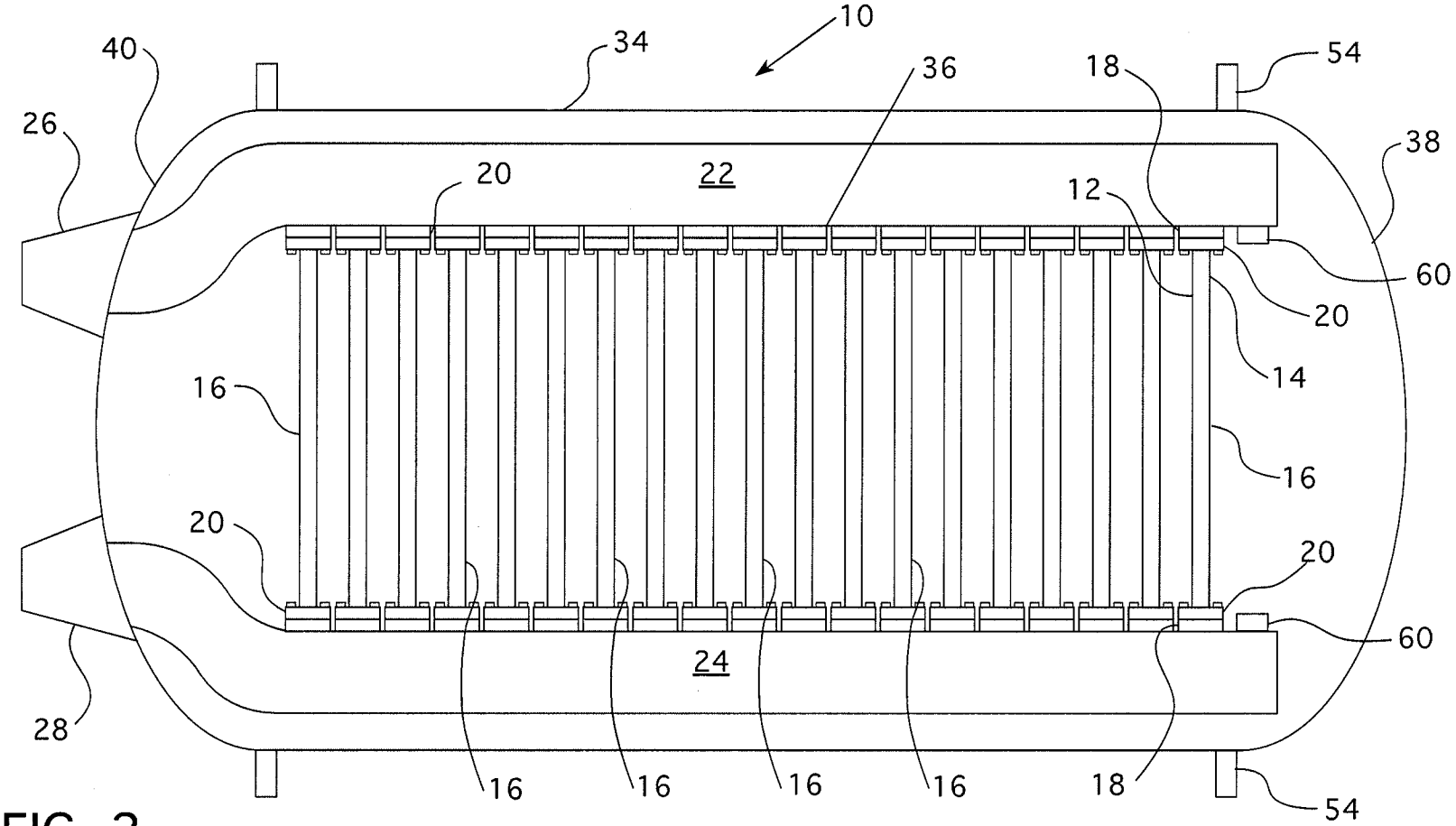
FIG. 2 is a top view of the feedwater heater shown in FIG. 1.

One embodiment of the feedwater heater, 10, of the inventions claimed hereafter is illustrated in the elevational view shown in FIG. 1 and the top view shown in FIG. 2. Two heat transfer plates 12 and 14 are welded together to form a welded plate pair 16 that therebetween form a flowpath for feedwater fluid as in a traditional plate heat exchanger. In one embodiment, the heat transfer plate pair 16 is removably connected, such as with gaskets 18 and bolted flange joints 20, to and in fluid communication with an inlet header pipe 22 at one end of the welded heat transfer plate pair 16 and an outlet header pipe 24 at the other end of the welded heat transfer plate pair 16. A number of these welded heat transfer plate pairs 16 are stacked in a spaced tandem arrangement, each coupled between the inlet header and outlet header to form a heat transfer assembly having a parallel flow path. One such arrangement is shown in FIG. 2. Alternately, it should be appreciated that a number of the heat transfer plate pairs 16 can be coupled in series with the ends of the series arrangement removably attached in a similar fashion to the inlet header pipe 22 and the outlet header pipe 24. In either embodiment, the terminal ends of the heat transfer plate pairs 16 are connected either directly or indirectly to the inlet header pipe 22 and the outlet header pipe 24. The inlet header pipe 22 and the outlet header pipe 24 are respectively connected to a feedwater inlet and a feedwater outlet nozzle 26 and 28 preferably using a bolted closure with gaskets in a manner similar to that described for removably fastening the pair of heat transfer plates 16 to the inlet and outlet header pipes 22 and 24, though it should be appreciated that other means of removable attachment may be used.

In the embodiment shown in FIGS. 1 and 2, the header pipes 22 and 24 are supported by a frame structure 30 which rests on an internal track 32 attached to the lower portion of the cylindrical shell 34 that forms a pressure vessel that surrounds the heat transfer plate assembly 36. The track 32 and wheels 33 on the frame structure 30 facilitate removal of the heat transfer plate assembly from the shell for repair, cleaning or uprating. In one embodiment the shell has an integral hemispherical end 38 on one side and a removable hemispherical head 40 on the other side to completely enclose and seal the heat transfer assembly 36 within the pressure vessel formed by the cylindrical shell 34, hemispherical end 38 and removable head 40. However, it should be appreciated that the ends need not be hemispherical to take advantage of this invention, though hemispherical ends are preferable for high pressure applications. The removable head 40 has the feedwater inlet nozzle 26 and the feedwater outlet nozzle 28 extending therethrough as shown in FIGS. 1 and 2. Alternately, the hemispherical end 38 can be constructed to be removable instead of the head 40 or both can be connected by bolted flange connections to the shell 34 for added flexibility in gaining access to the interior of the shell 34 to service the heat transfer plate assembly 36. The shell 34 is also fitted with an extraction steam inlet 42, drain inlets 44 and 46 and drain outlets 48 and 50.

During operation, the inlet feedwater passes through the inlet nozzle 26, the inlet header pipe 22, the heat transfer welded plate pairs 16 where it is heated by the drain flow and extraction steam, the outlet header pipe 24 and the outlet nozzle 28. The extraction steam, upon entering the feedwater heater through the extraction steam inlet 42, is distributed by the steam impingement plate 52 and passes through the upper shell region where it mixes with the entering drain flow from the drain flow inlet nozzles 44 and 46. The extraction steam and drain flow then pass between the heat transfer plate welded pairs 16, where it is cooled by the feedwater and condenses to the lower shell region where it exits through the drain flow outlet nozzles 48 and 50.

During a plant outage, an inspection of the heat transfer plates and shell internal surface can be performed using the following steps. First, the shell end 38 is unbolted at the flange 54 and removed. The header pipes 22 and 24 may then be disconnected from the inlet and outlet nozzles 26 and 28. A manway 56 on the head 40 can be used to gain access to the connection between the inlet and outlet header pipes 22 and 24 and the inlet and outlet nozzles 26 and 28. Alternately, when the head 40 is removed at the flange 58, the head 40 can be moved out with the heat transfer assembly 36 sliding on the track 32 so that access can be gained to the connection between the inlet and outlet headers 22 and 24 and the feedwater inlet and outlet nozzles 26 and 28. Spool piping (not shown) will need to be removed from the inlet and outlet nozzles 26 and 28 before moving the head 40. Next, the heat transfer plate assembly 36 can be moved as a unit along the tracks 32 located in the bottom of the shell 34 to a point where the individual heat transfer plates 12 and 14 and the interior of the shell 34 can be inspected for damage. The individual heat transfer plate pairs 16 can then be cleaned or, if necessary, repaired or replaced. If repair or replacement is necessary, the heat transfer plate pair 16 in need of attention can be unbolted from the inlet header pipe 22 and the outlet header pipe 24 and replaced with a new or repaired heat transfer plate pair 16 bolted in its place. The outlet header pipe 24 and inlet header pipe 22 are also provided with one or more additional openings 60 that are initially sealed by plugs. These additional openings can be unsealed to accommodate additional heat transfer plate pairs 16 if uprating in the future is desirable.

The removable plate design allows for replacement of the heat transfer surface and mass production of heat transfer plates and gaskets results in a relatively low cost for critical spares. Employing this design makes it possible to increase the number of plates and thus the heat transfer area to accommodate power uprates and provides improved shell side inspection.

Figure 3:
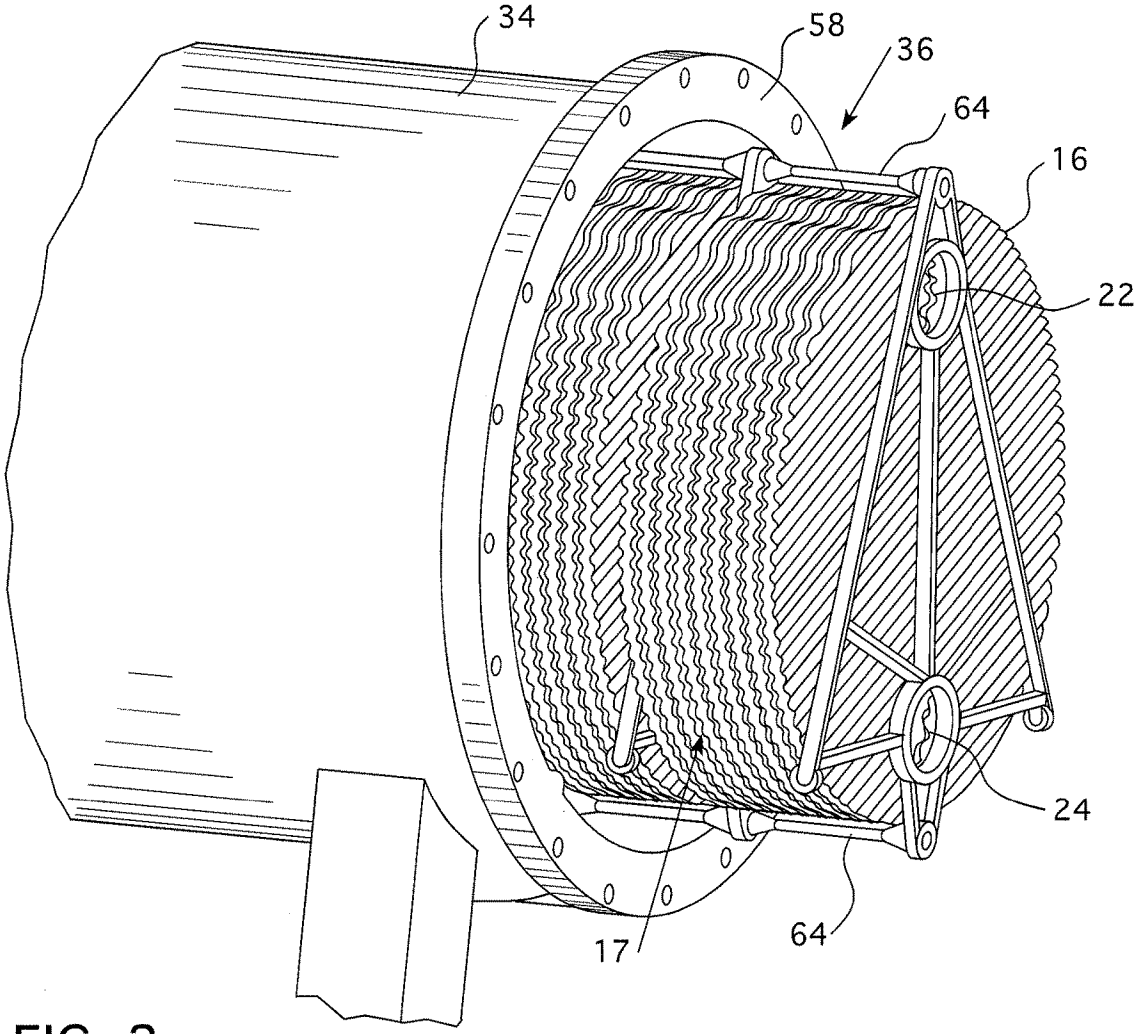
FIG. 3 is a perspective view of another embodiment of the feedwater heater of this invention with the heat transfer assembly separated into modules and partially removed from the shell.
Figure 4:
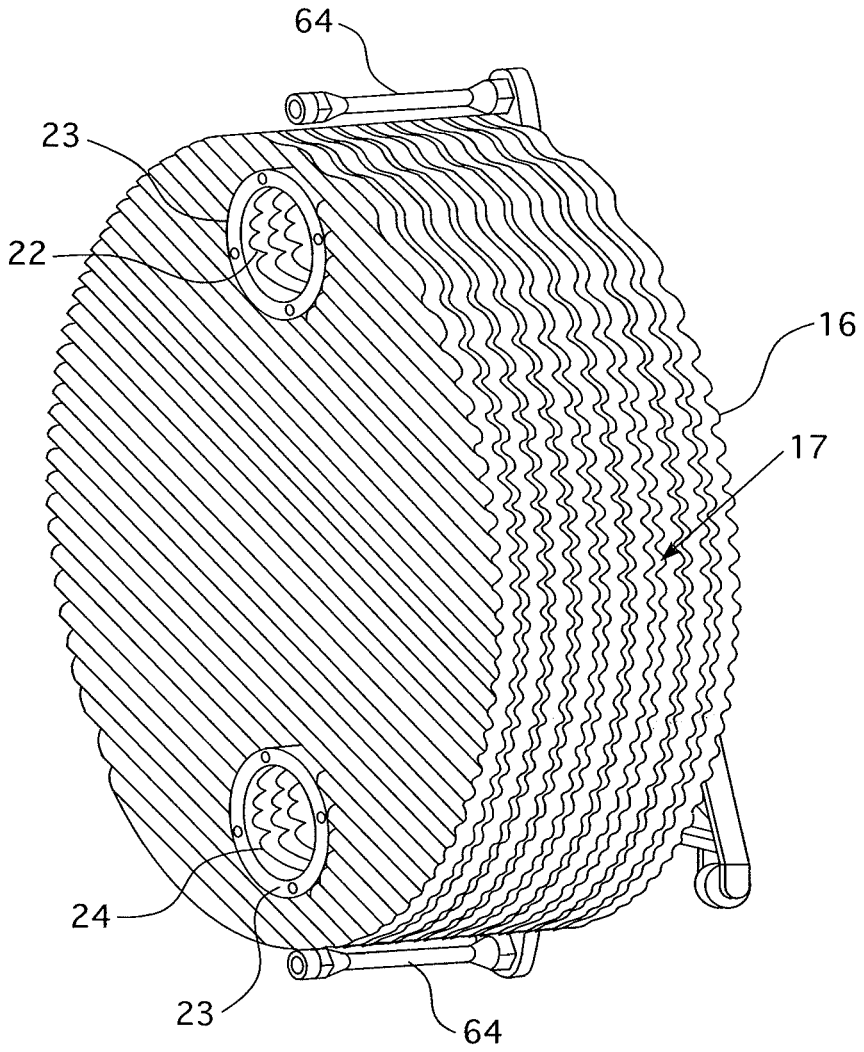
FIG. 4 is a perspective view of one of the end modules of pairs of heat transfer plates of the embodiment shown in FIG. 3.
Figure 5:
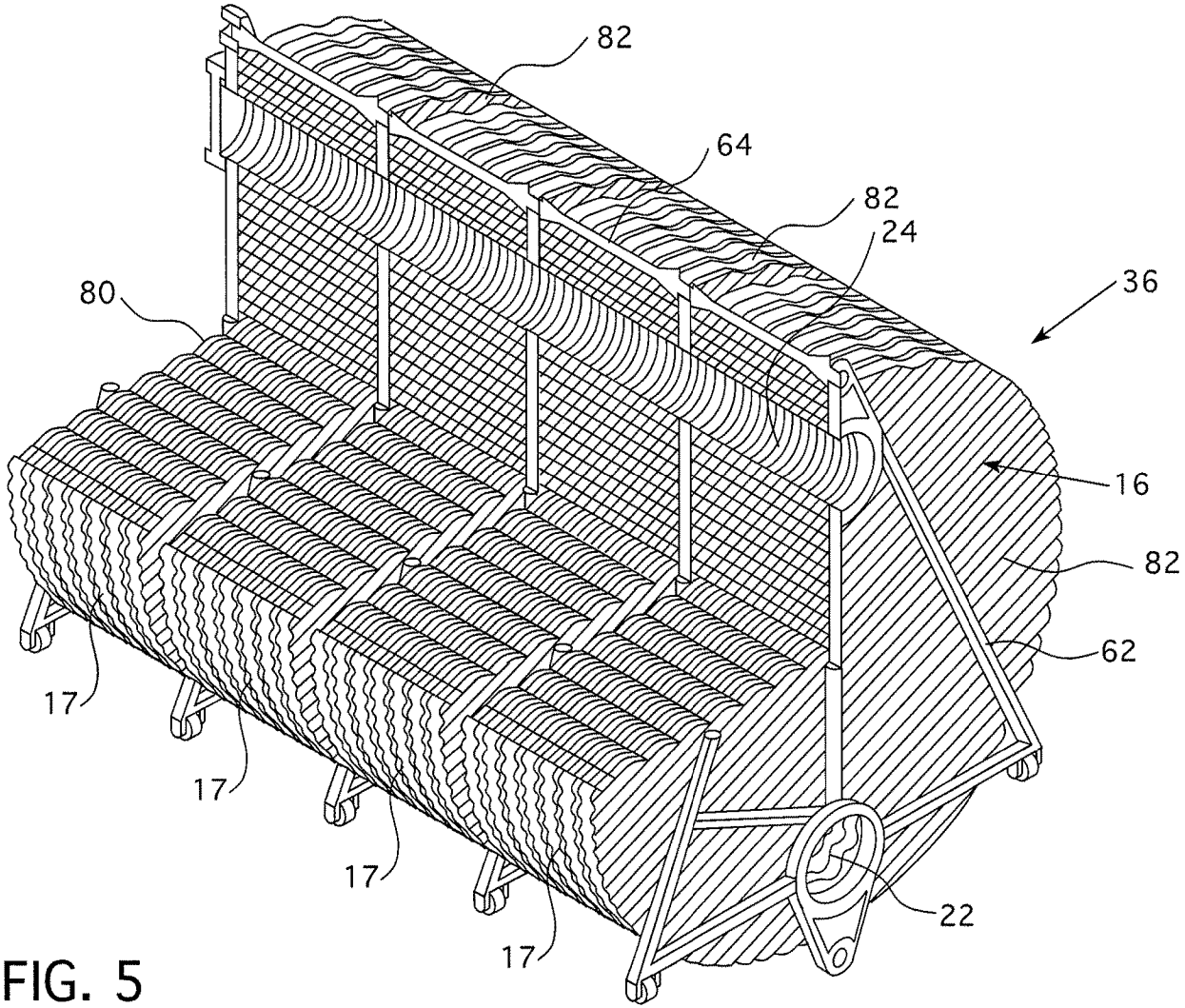
FIG. 5 is a perspective view, with a portion cut away, of the heat transfer assembly partially shown in FIGS. 3 and 4.

While specific embodiments of the invention have been described in detail, it will be appreciated by those skilled in the art that various modifications and alternatives to those details could be developed in light of the overall teachings of the disclosure. For example, while separate inlet and outlet header pipes or conduits are shown in the embodiment illustrated in FIGS. 1 and 2, any other structure that performs their stated function may also be used without departing from the spirit of this invention. For instance, the embodiment of the heat transfer assembly 36 shown in FIGS. 3, 4 and 5, shows segments of the inlet and outlet conduits 22 and 24 as integral parts of the heat transfer plate pairs 16. In FIGS. 3, 4 and 5 corresponding components to that shown in FIGS. 1 and 2, are given like reference characters. The heat transfer plate assembly 36 in the embodiment shown in FIGS. 3, 4 and 5 is formed from a number of heat transfer plate modules 17. Four such heat transfer plate modules are visible in FIG. 5. Each such module 17 is formed from a number of tandemly spaced heat transfer plate pairs 16 which are bonded together as an integral unit. Each of the modules 17 shown in FIGS. 3, 4 and 5 has approximately 10 such heat transfer plate pairs, though it should be appreciated that any number of such heat transfer plate pairs 16 may be used with the consequence that the more heat transfer plate pairs 16 to a module 17 the more costly the module will be to replace. Alternatively, the more modules there are the more will be spent on gaskets and closure hardware. An optimum range of the number of plates per module should be determined on an application specific basis based on economic considerations. Also, the number of modules 17 in the heat transfer assembly 36 may vary depending on the number of heat transfer plate pairs 16 per module and the heat transfer requirements of the application in which the heat exchanger is going to be employed.

In the embodiment shown in FIGS. 3, 4 and 5 the outer surface (i.e., the front and the back) of each heat transfer plate pair 16 has two openings on either side with the corresponding openings substantially aligned with each other and to which incremental segments 23 of the inlet and outlet conduits 22 and 24 are bonded such as by welding, brazing or any other suitable bond that forms a substantially rigid durable joint that is substantially impervious to the fluids flowing in and around the inlet and outlet conduits 22 and 24 in the area between the heat transfer plate pairs 16. The incremental segments of the inlet and outlet conduits 22 and 24 that pass between the heat transfer plate pairs 16 and the outside surface of the adjoining heat transfer plate pairs 16 provide a flow path between the heat transfer plate pairs 16 for the extraction steam and drain flow to pass. The outer end of the segments 23 of the inlet and outlet conduits 22 and 24 formed through each module 17 preferably have a flange on which the corresponding flange of an adjacent heat transfer plate module segment 23 can be connected; preferably with a gasket pressed between the flanges. The outer segments 23 on each module 17 may then be attached to a corresponding segment 23 on the outer side of an adjacent module with a gasket in between using the tie rods 64 shown in FIGS. 3, 4 and 5, though other forms of mechanical attachment may be used in place of the tie rods. In the embodiment shown in FIGS. 3, 4 and 5, the modules 17 are held in position by front and rear face frames or plates 62 that are drawn together by tie rods 64. The face plate 62 in the front of the heat transfer plate assembly has openings for the inlet and outlet conduits 22 and 24 so that the flanges on the outer segments 23 can be respectively attached to the inlet and outlet nozzles 26 and 28 (shown in FIG. 2). The outer segments 23, i.e., both inlet and outlet on the rear heat transfer plate at the end 80 of the heat transfer assembly 36 are either plugged to close the feedwater flow loop or the rear heat transfer plate is made without the inlet and outlet holes.

Figure 6:
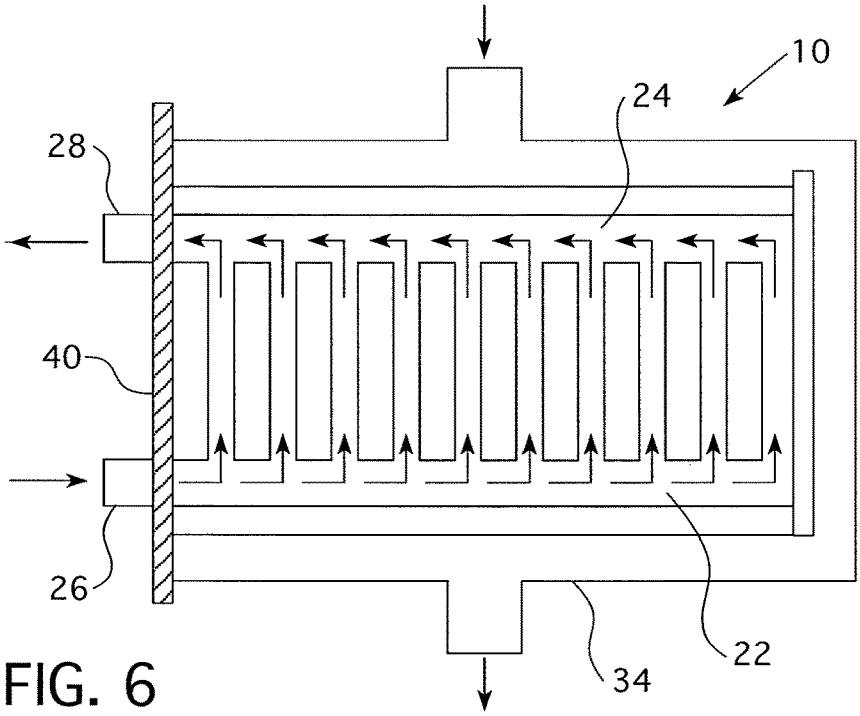
FIG. 6 is a schematic of the flow of primary fluid through the embodiment of the feedwater heater illustrated in FIGS. 3-5.
Figure 7:
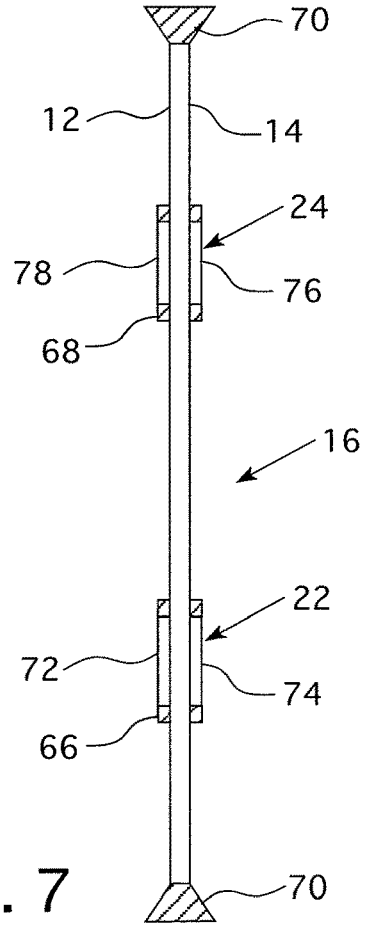
FIG. 7 is a side view of a heat transfer plate pair.

A schematic of the flow of the primary fluid through the heat transfer plate assembly of the embodiments described above having a parallel flow path through the heat transfer plate pairs 16 is illustrated in FIG. 6. FIG. 7 shows the construction of the heat transfer plate pairs. As shown in FIG. 7, a weld bead 66 extends around each of the incremental segments 23 of the inlet conduit 22 at the corresponding openings in the heat transfer plates 12 and 14 and form a fluid tight seal at the interface. Similarly, a weld bead 68 extends around the incremental segments 23 of the outlet conduit 24 at the corresponding openings in the heat transfer plates 12 and 14 and form a fluid tight seal at the interface. Furthermore, a girth weld 70 extends around the entire circumference of the heat transfer plate pair 16. As shown in FIG. 7, the primary fluid enters the inlet conduit 22 inlet 72 of each heat transfer plate pair 16 connecting it to adjacent pairs or support plates. A portion of the fluid flows down between the heat transfer plates 12 and 14 where it absorbs heat from the extraction steam and drain flow passing on the outside of the heat transfer plate pairs and exits at the outlet 78 to the outlet conduit 24 where it joins with the primary fluid upstream flow from other heat transfer plate pairs that entered through the outlet conduit inlet 76 to the heat transfer plate pair 16. Except for the last heat transfer plate pair 16 at the end 80 (FIG. 5) of the heat transfer plate assembly 36, the remainder of the primary fluid entering the inlet 72 which did not flow between the heat transfer plates 12 and 14 of a given heat transfer plate pair 16 exits through the inlet conduit outlet 74 to the next heat transfer plate pair 16. All of the primary fluid traversing the inlet conduit to the end 80 of the heat transfer plate assembly 36 is conducted through the last pair of heat transfer plates 12 and 14 where it exits through the outlet conduit 24 as shown in FIG. 6. It is irrelevant whether the water flows up (as shown in FIG. 6), down (as described here) or sideways through the heat transfer plate pairs 16 as long as the flow extends from the inlet conduit 22 to the outlet conduit 24.

Figure 8:
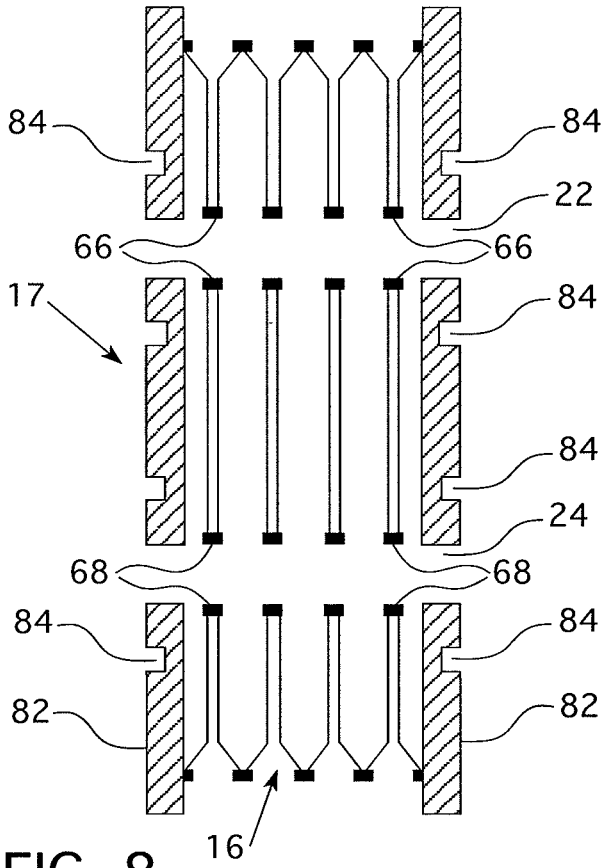
FIG. 8 is a schematic view of one embodiment of a heat transfer plate module described hereafter.

FIG. 8 is a schematic of one embodiment of a heat transfer plate module 17. The module 17 is shown with four heat transfer plate pairs 16, though as previously stated the number of heat transfer plate pairs 16 may vary. The heat transfer plate pairs 16 have relatively thin heat transfer plates 12 and 14, as compared to the outer support plates 82, which are thicker than the inner heat transfer plate pairs 16. The support plates 82 are referred to as support plates and are longer than the others and extend past the others to accept the tie rods shown in FIGS. 3, 4 and 5, though it should be appreciated that this embodiment is slightly different than the embodiment shown in FIGS. 3, 4 and 5. However, the way in which the modules are secured to each other is the same, though it should be appreciated that other means of securing the modules together, e.g., continuous threaded rods, bolts, etc., could also be used. The inner heat transfer plates are welded to each other with the conduit incremental segments 23 (shown in FIG. 4) extending therebetween, with the welds extending around the circular openings in the incremental segments of the inlet conduit 22 and outlet conduit 24, and the outer edges by the circumferential plate welds 70. Gasket grooves 84 are provided around the inlet conduit 22 and outlet conduit 24 openings in the support plates 82 for gaskets to seal the openings at the interface with mating support plates 82 of adjoining modules 17.

Figure 9:
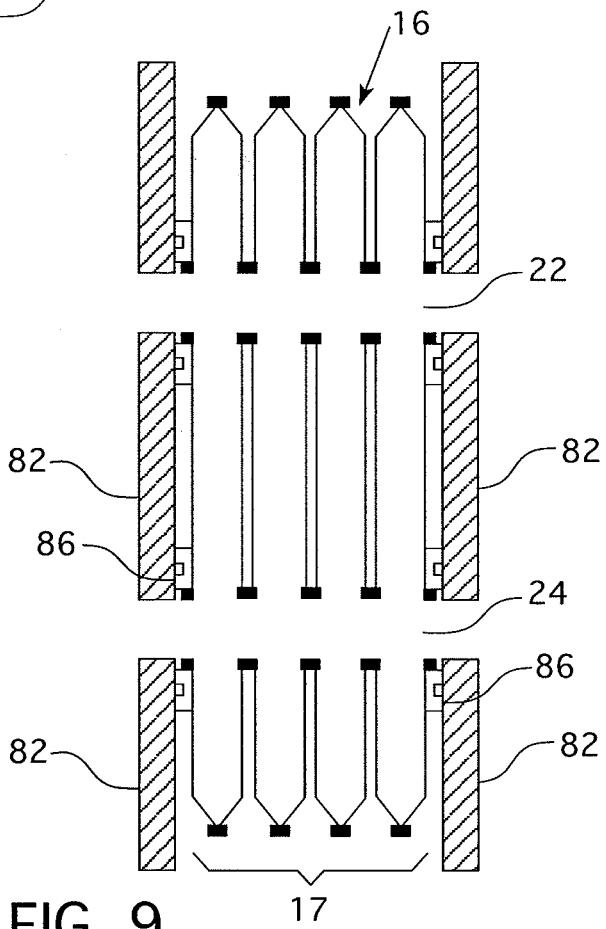
FIG. 9 is a schematic view of a second embodiment of a heat transfer plate module described hereafter.

A second embodiment of a heat transfer plate pair module 17 is shown in FIG. 9. The embodiment shown in FIG. 9 is very similar to that described above with regard to FIG. 8 except the outside heat transfer plates have a gasket retaining ring 86 around the openings to the inlet conduit 22 and outlet conduit 24. A single support plate is interposed between the modules 17 and gaskets on the retaining rings 86 seal the openings 22 and 24 between each support plate and the heat transfer plates. Alternately, grooves can be provided on one or both sides of the support plates for retaining the gaskets.

Figure 10:
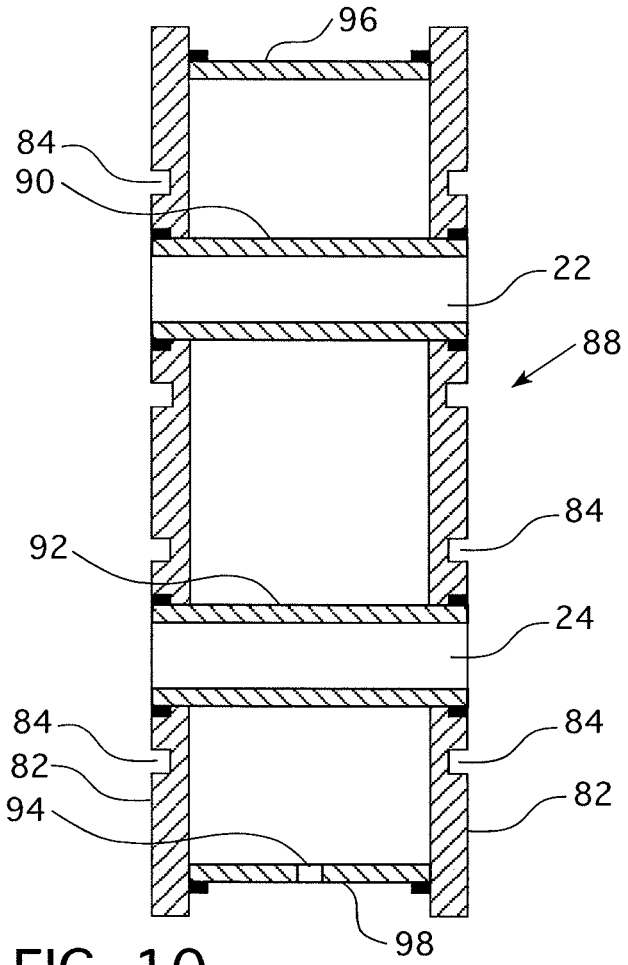
FIG. 10 is a sectional view of a spacer module described hereafter.

A spacer module 88 may be inserted in place of a heat transfer plate pair module 17 to preserve space for the later addition of another heat transfer plate pair module 17 should a future uprating of the plant in which the heat exchanger is installed require additional heat transfer capacity within the existing shell. One embodiment of such a spacer module 88 is illustrated in FIG. 10. The spacer module 88 is, preferably, the same size as a standard heat transfer plate pair module 17 for the heat exchange unit 10 in which it is to be employed. The spacer module in this embodiment has two support plates 82 with gasket grooves 84, as previously described, that are separated by an upper support 96 and lower support 98 with a secondary fluid drain 94. It should be appreciated that the upper support 96 and lower support 98 may (but need not) be part of one continuous support cylinder. The embodiment shown in FIG. 10 is intended to be inserted between heat transfer plate pair modules 17 and has a pipe 90 which is welded around its circumference at each support plate interface to form a hermetic seal. The pipe 90 forms a portion of the inlet conduit 22, carrying the primary fluid between the heat transfer plate pair modules 17 that it connects. Similarly a pipe 92 is sealed to and spans the space between the support plates 82 of the spacer module 88 to carry the primary fluid through the outlet conduit 24. If the spacer is used at the end of the end 80 of the heat transfer plate assembly 36 then the openings in the spacer module support plates 82 is unnecessary.

Figure 11:
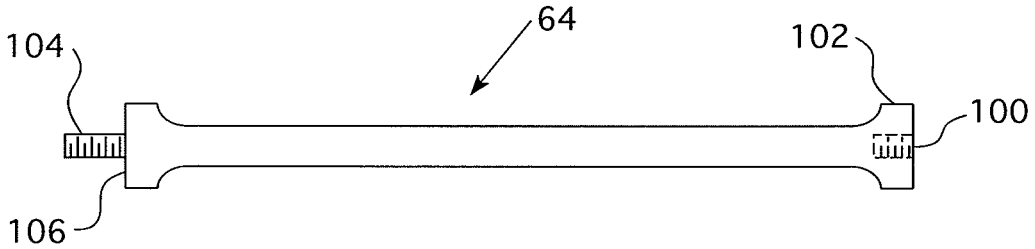
FIG. 11 is a side view, partially in section, of a tie rod segment which can be employed to couple two heat transfer plate modules.

FIG. 11 illustrates one embodiment of a tie rod arrangement that can be used to draw the modules 17 and 88 together. The tie rod 64 is designed to span between support plates 82, similar to the spans between support frames 62 shown in FIG. 5. In the embodiment shown in FIG. 11, the tie rods 64 have one end with a reduced diameter that has a circumferential thread 104. The circumferential thread 104 terminates at a bearing surface 106 that is sized to abut one side of a periphery of a module support plate around a hole in which the thread 104 is sized to extend through and out the other side. The other end of the tie rod 64 has an internal thread 100 that is sized to mate with an external circumferential thread 104 on an adjoining tie rod 64 which is extended through a corresponding hole in an adjoining support plate 82. Preferably, the outer circumference 102 around tie rod end having the internal thread 100 has a square or hex contour on which a torque can readily be applied.

As previously mentioned, the heat transfer plate assembly 36 has wheels 33 that ride on the track 32 previously described to facilitate servicing of the heat transfer plate assembly. Servicing is the same as described for the embodiment illustrated in FIGS. 1 and 2, except to uprate the heat transfer plate assembly, the spacer module 88 is removed and an additional heat transfer plate module 17 is coupled in its place.

Additionally, while the preferred embodiment is described in an application to a feedwater heater the invention can be employed with similar benefits in most other types of heat exchangers. Accordingly, the particular embodiments disclosed are meant to be illustrative only and not limiting as to the scope of the invention which is to be given the full breadth of the appended claims and any and all equivalents thereof.

What is claimed is:

1. A heat exchanger, comprising:

an elongated pressure vessel shell having an axial dimension with a removable head at one end of the axial dimension, a primary fluid inlet, a primary fluid outlet, a secondary fluid inlet, a drain outlet and a heat transfer assembly comprising:

a primary fluid inlet conduit extending into the pressure vessel from the primary fluid inlet;

a primary fluid outlet conduit extending into the pressure vessel from the primary fluid outlet;

a plurality of pairs of heat transfer plates supported in tandem with each of the pairs of plates sealed around a periphery to define a primary fluid flow channel in between a first and second heat transfer plate of each pair, with each pair having a heat transfer plate inlet opening fluidly connected either directly or indirectly to the primary fluid inlet conduit and a heat transfer plate outlet opening fluidly connected either directly or indirectly to the primary fluid outlet conduit to form a parallel flow path with flow in the same direction as the parallel flow path through each of the other pairs of heat transfer plates in a direction orthogonal to the axial dimension of the pressure vessel shell; and a spacer module configured to preserve room for later adding heat transfer capacity, the spacer module comprising a first support plate, a second support plate spaced from and disposed opposite the first support plate, and at least one support extending between the first and second support plates, wherein the plurality of pairs of heat transfer plates are arranged in modules with at least one of the modules, including at least one of the pairs of heat transfer plates, connected in tandem with an adjacent module or the primary fluid inlet or the primary fluid outlet with a nondestructively removable mechanical coupling, wherein the spacer module has substantially less heat transfer capacity than the modules of pairs of heat transfer plates, the spacer module being connected in tandem with the modules of pairs of heat transfer plates, the spacer module being at least as long in the axial dimension as the modules of the pairs of heat transfer plates and having an inlet duct passing axially therethrough, fluidly connected either directly or indirectly to the primary fluid inlet conduit and an outlet duct passing axially therethrough, fluidly connected either directly or indirectly to the primary fluid outlet conduit, wherein the inlet duct comprises a first pipe and the outlet duct comprises a second pipe each spanning between said first support plate and said second support plate and wherein the first pipe forms a portion of the primary fluid inlet conduit; and wherein the second pipe forms a portion of the primary fluid outlet conduit.

2. The heat exchanger of claim 1 wherein the at least one of the modules includes a plurality of the pairs of heat transfer plates with the pairs of heat transfer plates within the at least one of the modules supported together with a tie rod.

3. The heat exchanger of claim 2 wherein the at least one of the modules connected in tandem with an adjacent module is connected by coupling their respective tie rods.

4. The heat exchanger of claim 3 wherein the heat transfer assembly is slidable out of the pressure vessel shell when the removable head is opened.

5. The heat exchanger of claim 1 wherein the primary fluid inlet and the primary fluid outlet extend from the removable closure.

6. The heat exchanger of claim 1 wherein the heat transfer assembly is fitted with a number of extra couplings configured to attach additional pairs of heat transfer plates, the extra couplings are initially plugged and are available for later uprating of the heat transfer capability of the heat exchanger after the heat exchanger has been placed in operation over the original heat transfer capacity, by unplugging at least some of the extra couplings and attachment of a number of the additional pairs of heat transfer plates.

7. The heat exchanger of claim 1 wherein the pressure vessel shell is a cylindrical shape with hemispherical ends.

8. The heat exchanger of claim 1 wherein at least some of the modules comprise a plurality of the pairs of heat transfer plates with each of the pairs of heat transfer plates within a module connected together in the tandem array via a welded coupling.

9. The heat exchanger of claim 1 wherein at least some of the modules have a support plate on a first and a second end with the heat transfer plates therebetween wherein the support plates are thicker than the heat transfer plates.

10. The heat exchanger of claim 1 wherein the modules are supported in tandem by tie rods.

11. The heat exchanger of claim 1 wherein the heat transfer assembly is moveably supported on a track attached to an inside of the pressure vessel so that the heat transfer assembly can be removed as a unit from the pressure vessel through the one end by moving the heat transfer assembly along the track.

12. The heat exchanger of claim 11 wherein the heat transfer assembly is supported on the track on wheels that ride on the track.

13. The heat exchanger of claim 1 wherein the first pipe and the second pipe are each welded around their respective circumferences at each of said first support plate and said second support plate.

14. A method of cleaning or repairing the heat exchanger of claim 1 comprising the steps of:

accessing the interior of the pressure vessel shell;

removing at least one pair of heat transfer plates from the heat transfer assembly;

cleaning, repairing or replacing the removed pair(s) of heat transfer plates;

reconnecting the cleaned, repaired or replaced pair(s) of heat transfer plates to the heat transfer assembly.

15. The method of cleaning or repairing the heat exchanger of claim 14 wherein the step of accessing the interior of the pressure vessel shell comprises either removing the removable closure from the one end or opening a manway on the pressure vessel shell and the step of removing at least one pair of heat transfer plates comprises removing the at least one pair of heat transfer plates from the primary fluid inlet conduit and the primary fluid outlet conduit.

16. A method of repairing, inspecting, cleaning or uprating the heat exchanger of claim 1 comprising the steps of:

accessing the interior of the pressure vessel shell; and disconnecting the primary fluid inlet conduit and the primary fluid outlet conduit from the primary fluid inlet and the primary fluid outlet, respectively.

17. The method of claim 16 including the step of replacing a defective pair of heat transfer plates.

18. The method of claim 17 wherein the plurality of pairs of heat transfer plates is a first number of pairs of heat transfer plates, the method further including the step of increasing the number of pairs of heat transfer plates from the first number to a second number within the heat transfer assembly after the heat exchanger has been placed in operation to uprate the heat exchanger, the second number being greater than the first number.

* * * * *